US005774159A

United States Patent [19]

Larson

[11] Patent Number: 5,774,159

[45] Date of Patent: Jun. 30, 1998

[54] DIRECT PRINTING METHOD UTILIZING CONTINUOUS DEFLECTION AND A DEVICE FOR ACCOMPLISHING THE METHOD

[75] Inventor: Ove Larson, Västra Frölunda, Sweden

[73] Assignee: Array Printers AB, Vastra Frolunda, Sweden

[21] Appl. No.: 713,413

[22] Filed: Sep. 13, 1996

[51] Int. Cl.[6] ..... B41J 2/39; B41J 2/395; B41J 2/40

[52] U.S. Cl. ..... 347/151; 347/141; 347/147; 347/148

[58] Field of Search ..... 399/135; 347/55, 347/77, 141, 147, 148, 151, 123

[56] References Cited

U.S. PATENT DOCUMENTS

| | | | |
|---|---|---|---|
| 3,566,786 | 3/1971 | Kaufer, et al. . | |
| 3,689,935 | 9/1972 | Pressman et al. . | |
| 3,779,166 | 12/1973 | Pressman et al. . | |
| 4,274,100 | 6/1981 | Pond . | |
| 4,353,080 | 10/1982 | Cross . | |
| 4,384,296 | 5/1983 | Torpey . | |
| 4,470,056 | 9/1984 | Galetto et al. . | |
| 4,478,510 | 10/1984 | Fujii et al. . | |
| 4,498,090 | 2/1985 | Honda et al. . | |
| 4,814,796 | 3/1989 | Schmidlin . | |
| 4,831,394 | 5/1989 | Ochiai et al. . | |
| 4,860,036 | 8/1989 | Schmidlin . | |
| 5,028,812 | 7/1991 | Bartky . | |
| 5,036,341 | 7/1991 | Larsson . | |
| 5,038,159 | 8/1991 | Schmidlin et al. . | |
| 5,057,855 | 10/1991 | Damouth . | |
| 5,072,235 | 12/1991 | Slowik et al. . | |
| 5,083,137 | 1/1992 | Badyal et al. . | |
| 5,121,144 | 6/1992 | Larson et al. . | |
| 5,148,595 | 9/1992 | Doggett et al. . | |
| 5,170,185 | 12/1992 | Takemura et al. . | |
| 5,181,050 | 1/1993 | Bibl et al. . | |
| 5,204,696 | 4/1993 | Schmidlin et al. . | |
| 5,214,451 | 5/1993 | Schmidlin et al. . | |
| 5,237,346 | 8/1993 | Da Costa et al. . | |
| 5,256,246 | 10/1993 | Kitamura . | |
| 5,257,045 | 10/1993 | Bergen et al. | 347/123 |
| 5,274,401 | 12/1993 | Doggett et al. . | |
| 5,307,092 | 4/1994 | Larson . | |
| 5,402,158 | 3/1995 | Larson . | |
| 5,450,115 | 9/1995 | Bergen et al. | 347/123 |
| 5,515,084 | 5/1996 | Larson | 347/55 |
| 5,617,129 | 4/1997 | Chizuk et al. | 347/123 |

FOREIGN PATENT DOCUMENTS

| | | |
|---|---|---|
| 12 70 856 | 6/1968 | Germany . |
| 26 53 048 | 5/1978 | Germany . |
| 58-044457 | 3/1983 | Japan . |
| 2108432 | 5/1983 | United Kingdom . |
| 9014960 | 12/1990 | WIPO . |

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

*Primary Examiner*—Matthew S. Smith

*Attorney, Agent, or Firm*—Knobbe, Martens, Olson & Bear, LLP

[57] ABSTRACT

An apparatus and method provide direct electrostatic printing onto an information carrier. Computer-generated electronic signals define an image and are converted to a pattern of electrostatic fields to selectively control the deposition of charged toner particles in an image configuration directly onto the information carrier. The electrostatic fields are applied via a set of print electrodes which selectively permit or restrict the transport of the charged toner particles from a particle source toward the information carrier. Periodically variable deflection potentials are applied to a set of deflection electrodes to modify the trajectories of the toner particles as they are transported toward the information carrier to direct the toner particles in a direction transverse to the direction of the movement of the information carrier.

12 Claims, 8 Drawing Sheets

DIRECT PRINTING METHOD UTILIZING CONTINUOUS DEFLECTION AND A DEVICE FOR ACCOMPLISHING THE METHOD

BACKGROUND OF THE INVENTION

1. Field of the Invention

The present invention relates to a direct electrostatic printing method, in which a stream of computer-generated electronic signals, defining an image information, are converted to a pattern of electrostatic fields to selectively control the deposition of charged toner particles in an image configuration directly onto an information carrier.

2. Description of the Related Art

The most familiar and widely utilized electrostatic printing technique is that of xerography wherein latent electrostatic images formed on a charge retentive surface, such as a roller, are developed by suitable toner material to render the images visible, the images being subsequently transferred to an information carrier. This process is called an indirect process because it first forms a visible image on an intermediate surface and then transfers that image to an information carrier.

Another method of electrostatic printing is one that has come to be known as direct electrostatic printing. This method differs from the aforementioned xerographic method in that charged pigment particles are deposited directly onto an information carrier to form a visible image. In general, this method includes the use of electrostatic fields controlled by addressable electrodes for allowing passage of toner particles through selected apertures in a printhead structure. A separate electrostatic field is provided to attract the toner particles to an information carrier in image configuration.

The novel feature of direct electrostatic printing is its simplicity of simultaneous field imaging and toner transport to produce a visible image on the information carrier directly from computer generated signals, without the need for those signals to be intermediately converted to another form of energy such as light energy, as is required in electrophotographic printers, e.g. laser printers.

U.S. Pat. No. 5,036,341, granted to Larson, discloses a direct printing method which begins with a stream of electronic signals defining the image information. A uniform electric field is created between a high potential on a back electrode and a low potential on a toner carrier. That uniform field is modified by potentials on selectable wires in a two dimensional wire mesh array placed in the print zone. The wire mesh array consists of parallel control wires, each of which is connected to an individual voltage source, across the width of the information carrier. A drawback of such a device is that, during operation of the wire mesh array, the individual wires can be sensitive to the potentials applied on adjacent wires, resulting in undesired printing due to interaction or cross-talk between neighbouring wires.

U.S. Pat. No. 5,121,144, also granted to Larson, discloses a control electrode array formed of a thin sheet-like element comprising a plurality of addressable control electrodes and corresponding voltage signal sources connected thereto. The control electrode array may be constructed of a flexible, electrically insulating material and overlaid with a printed circuit such that apertures in the material are arranged in rows and columns and are surrounded by electrodes. An electrostatic field on the back electrode attracts toner particles from the surface of a particle carrier to create a particle stream toward the back electrode. The particle stream is modulated by voltage sources which apply an electric potential to selected individual control electrodes to produce electrostatic fields which permit or restrict particle transport from the particle carrier through the corresponding aperture. The modulated stream of charged particles allowed to pass through selected apertures impinges upon an information carrier interposed in the particle stream to provide line by line scan printing to thereby form a visible image.

The control electrodes are aligned in several transverse rows extending parallel to the motion of the information carrier. All electrodes are initially at a white potential $V_w$ preventing all toner transport from the toner carrier. As image locations on the information carrier pass beneath apertures, corresponding control electrodes are set to a black potential $V_b$ to produce an electrostatic field drawing the toner particles from the toner carrier. The toner particles are pulled through the apertures and deposited on the information carrier in the configuration of the desired image pattern. The toner particle image is then made permanent by heat and pressure fusing the toner particles to the surface of the information carrier.

Each aperture is associated with a specific addressable area on the information carrier. The addressable area of an aperture is the part of the information carrier which can be darkened by toner particles transported through the actual aperture during a print sequence. Common to all electrostatic printing methods is that toner particles are transported along a substantially straight trajectory coinciding with a central axis of the aperture, and impinge upon the information carrier at a substantially right angle, resulting in that the addressable area of each aperture is limited to a single "dot", having a predetermined, non-variable extension on the information carrier. The number of dots which can be printed per length unit in a longitudinal direction, i.e. parallel to the motion of the information carrier, can be increased by lowering the speed of the information carrier through the print zone, thereby allowing a larger number of print sequences per length unit to be performed.

A drawback of the aforementioned method is that the number of dots which can be printed per length unit in a transverse direction, i.e. perpendicular to the motion of the information carrier, is strictly limited by the number of apertures that can be arranged in the control array.

Hitherto, the transverse print addressability has generally been improved by increasing the number of apertures and related control electrodes across the control array, resulting in higher manufacturing cost and more complicated control function. However, increasing the number of apertures results in the apertures having to be spaced closer from each other, thereby causing the control electrodes to not only act on their associated aperture but also substantially influence all adjacent apertures, due to the interaction between adjacent electrostatic fields. This results in a degradation of the print quality and readability.

Therefore, regardless of the design of the control electrode array the present applicant has perceived a need to improve the print quality of direct printing methods by enhancing transverse print addressability, without increasing the number of addressable control electrodes required.

SUMMARY OF THE INVENTION

The present invention satisfies a need for higher quality direct printing methods, having improved transverse print addressability and grey scale capability.

This is achieved in accordance with the present invention in that the particle stream from a particle source through any selected aperture of the control array is simultaneously modulated by a control pulse and continuously deflected by a deflection pulse, resulting in that transported particles are distributed among several trajectories and deposited upon an increased addressable area on the information carrier.

According to the present invention, the particle transport through each selectable aperture is controlled by at least one print electrode and at least one deflection electrode.

A stream control pulse is supplied to the print electrode to produce an electrostatic field which at least partially opens or closes the aperture in accordance with the image information. The stream control pulse has an amplitude chosen to be above or below a predetermined transport threshold value to respectively permit or restrict particle transport from the particle source, and a pulse width chosen as a function of the amount of particles intended to be influenced.

A deflection pulse is supplied to the deflection electrode to produce a variable deflection force acting on the transported particles. The deflection pulse is a periodic function having an amplitude that oscillates between two predetermined levels, and a period adjusted to the period of a print sequence. Each value of the deflection force applied by the deflection pulse corresponds to a specific deviation of the particle trajectory from a central axis of the aperture.

As an amount of particles is transported from the particle source, the first particles passing through the aperture are deflected from their initial trajectory and obliquely transported in a first direction toward the information carrier. As the particles pass through the aperture, the amplitude of the deflection pulse is modulated to continuously modify the particle trajectory from said first direction to the opposite direction.

For instance, as the first particles pass through the aperture, the amplitude of the deflection pulse is set to a value $V_d$ which corresponds to a deflection force acting in a first direction toward the information carrier, such that said first particles are deposited at a distance d from a central axis of the aperture. During particle passage through the aperture, the amplitude of the deflection pulse is then continuously decreased to a value $-V_d$ which corresponds to a deflection force in a second direction opposed to said first direction toward the information carrier. The stream control pulse and the deflection control pulse are adjusted with respect to each other so that the amplitude value $-V_d$ is reached as the last particles pass through the aperture, those last particles being thereby deposited at a distance d from the central axis of the aperture. Consequently, the amount of particles transported through the aperture during the actual print sequence is uniformly spread throughout an addressable area which is centered about the central axis of the aperture and has a width approximately equal to 2d.

According to a preferred embodiment, the present invention relates to a direct electrostatic printing method including the following steps:

charged particles are conveyed to a particle source located adjacent to a back electrode; a uniform electrostatic field is produced between a first potential on the back electrode and a second potential on the particle source, thereby applying an attractive force to the charged particles; a control unit including print electrodes and deflection electrodes is provided in the uniform electrostatic field between the particle source and the back electrode; a stream of computer-generated control signals, defining an image information, is converted to a pattern of electrostatic fields, such that each electrostatic field is chosen to be above or below a transport threshold value for print or no print, respectively, thereby allowing or preventing an appropriate amount of charged particles to be attracted from the particle source by said attractive force from the back electrode;

during particle transport, the symmetry of each electrostatic field is continuously modified by a periodic deflection pulse acting in the vicinity of each print electrode, thereby also continuously modifying the path trajectory of the transported charged particles; an information carrier is interposed between the array of control electrodes and the back electrode, whereby the transported charged particles are deposited on the information carrier in an image configuration.

Accordingly, each single amount of charged particles attracted from the particle source through an aperture is transported toward the information carrier along continuously modified trajectories, and uniformly distributed on the addressable area. The information carrier may be composed of a plurality of addressable areas touching or overlapping each other to ensure complete coverage of the entire surface of the information carrier. Each addressable area can be totally or partially coated with toner particles in accordance with the image information. The portion of an addressable area which is intended to be coated (addressed) by toner particles is thus determined by the width of the corresponding stream control pulse.

The deflection pulse can oscillate from an initial level modifying the symmetry of the control fields in a first direction, to an opposite level modifying the field symmetry in the opposite direction. Accordingly, maximal trajectory deflection (and resulting maximal addressed area) is obtained by applying a stream control pulse having a width corresponding to an entire period of the deflection pulse. The addressed area is made smaller by decreasing the width of the stream control pulse. In that case, the deflection pulse acts on the transported particles during only a part of its period, corresponding to lower amplitudes. The deflection forces applied on the transported particles are thus comprised within a smaller range, lowering the particle divergence.

An important object of the present invention is to enhance grey scale capability by continuously modulating the addressed area of each aperture. Accordingly, the pulse width of the stream control signals is modulated to allow variable amounts of charged particles to be transported from the particle source, each single amount of transported particles being uniformly deflected, thus uniformly distributed within the appropriate addressed area. Hereby, a plurality of different shades, comprised between a maximal addressed area, corresponding to maximal darkness, and a minimal addressed area, corresponding to white, are created in accordance with the image information. The present invention allows a continuous grey scale variation that considerably improves the print quality of direct printing methods.

The present invention also relates to a device for accomplishing the aforementioned method, such a device including:

a back electrode;

a particle carrying unit positioned to convey charged particles to a particle source located adjacent to the back electrode;

a control array interposed between the particle source and the back electrode, said control array comprising a plurality of apertures, each aperture being controlled by at least one print electrode and at least one deflection electrode;

a particle receiving information carrier positioned between the control array and the back electrode;

a back voltage source connected to the back electrode, to produce an electrostatic field between the back electrode and the particle source;

a plurality of variable voltage sources connected to apply control potentials to each print electrode, said control potentials having sufficient magnitude to selectively permit or restrict transport of the charged particles from the particle source to the information carrier, and at least one deflection voltage source connected to apply variable deflection potentials to the deflection electrodes, said deflection potentials having sufficient magnitude to modify the path trajectory of the charged particles transported toward the information carrier.

According to a preferred embodiment of the present invention, the control array is formed of a substrate of flexible, electrically insulating material provided with a plurality of apertures arranged therethrough, each aperture being surrounded by a ring-shaped print electrode arranged symmetrically about a central axis of the aperture to ensure uniform distribution of charged particles transported therethrough, each of said ring-shaped print electrodes being associated with a first and a second deflection electrode. Said first deflection electrode is positioned adjacent to the ring-shaped print electrode and spaced around a first segment of the circumference thereof. Said second deflection electrode is positioned adjacent to the ring-shaped print electrode and spaced around a second segment of the circumference thereof, such that said first and second segments are arranged symmetrically about a central axis of the aperture, along a deflection axis extending through the center of the aperture. A first deflection pulse is supplied to said first deflection electrode to apply deflection forces deflecting the particle trajectory in the direction of said first segment. A second deflection pulse is supplied to said second deflection electrode to apply deflection forces deflecting the particle trajectory in the direction of said second segment. Both deflection pulses are adjusted with respect to each other to produce a potential difference between the first and second deflection electrodes, said potential difference varying continuously during the transport of charged particles from the control array to the information carrier.

BRIEF DESCRIPTION OF THE DRAWINGS

The invention will be described in the following in greater detail by way of example only and with reference to the attached drawings, in which.

LIST OF REFERENCES USED IN THE DRAWINGS

1- back electrode
$V_{BE}$ back potential
2- particle carrying unit
20- charged particles (toner)
21- toner container
22- print zone
23- developer sleeve
24- supply brush
25- toner feeder
26- metering blade
3- control unit
30- control array
301 first layer of the control array
302 second layer of the control array
31- aperture
311- central axis of an aperture
312- deflection axis of an aperture
32- print electrode (print electrode)
33- deflection electrode (deflection electrode)
331- first deflection electrode
332- second deflection electrode
34- control voltage source
$V_{34}$- print potential
35- deflection control source
351- first deflection voltage source
$V_{351}$- first deflection potential
352- second deflection voltage source
$V_{352}$- second deflection potential
4- information carrier
41- total addressable area related to an aperture

DETAILED DESCRIPTION OF THE EMBODIMENTS

Figure 1:
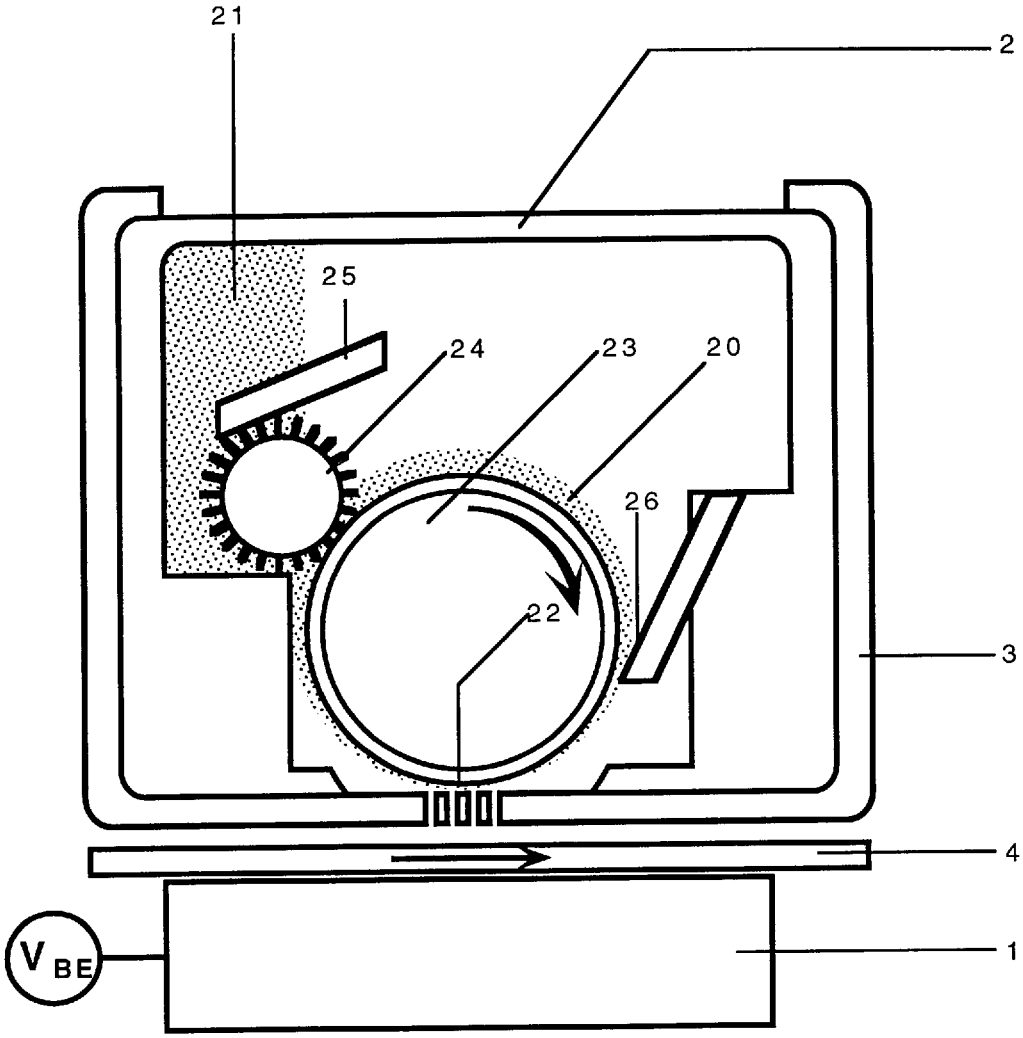
FIG. 1 is a schematic sectional view of an image recording apparatus according to the present invention in the form of a direct electrostatic printing device.

FIG. 1 is a schematic illustration of a direct electrostatic printing device including:

a back electrode 1 connected to a back voltage source supplying a back potential $V_{BE}$;

a particle carrying unit 2, comprising at least one rotating developer sleeve 23 having a surface coated with a thin layer of uniformly charged toner particles 20;

a control unit 3, comprising print electrodes to selectively permit or restrict particle transport, and deflection electrodes to continuously deflect the stream of transported particles, and an information carrier 4, such as a sheet of plain, untreated paper which is fed between the particle carrying unit 2 and the back electrode 1 by means of a paper feeding unit (not shown).

Toner particles 20 are conveyed in the particle carrying unit 2, from a toner container 21 to the surface of the developer sleeve 23, by means of a supplying device, such as a rotating supply brush 24, a toner feeder 25 and a metering blade 26 that ensure a uniform thickness of the toner layer on the sleeve surface. Toner particles 20 are preferably charged by contact with the fibrous material of the supply brush 24, by charge exchange with the surface material of the sleeve 23 or by any other suitable way. Toner particles 20 are conveyed on the sleeve surface to the print zone 22 to a position adjacent to the back electrode 1. The back potential ($V_{BE}$) produces a uniform electric field between the back electrode 1 and the sleeve surface to apply attractive electric forces to the charged toner particles 20.

Figure 2A:
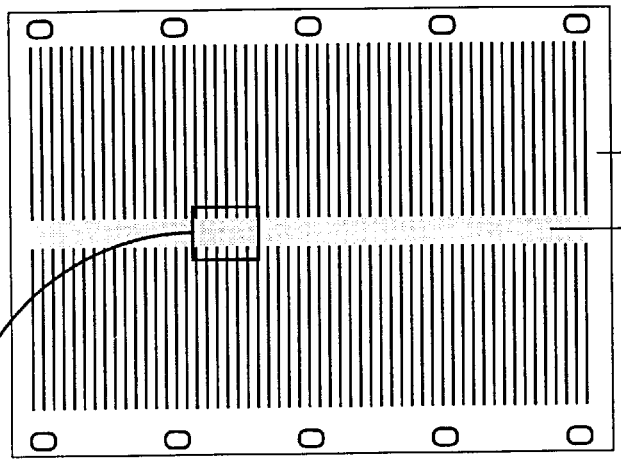
FIG. 2*a* is a schematic plan view of a control unit comprising a control array.
Figure 2B:
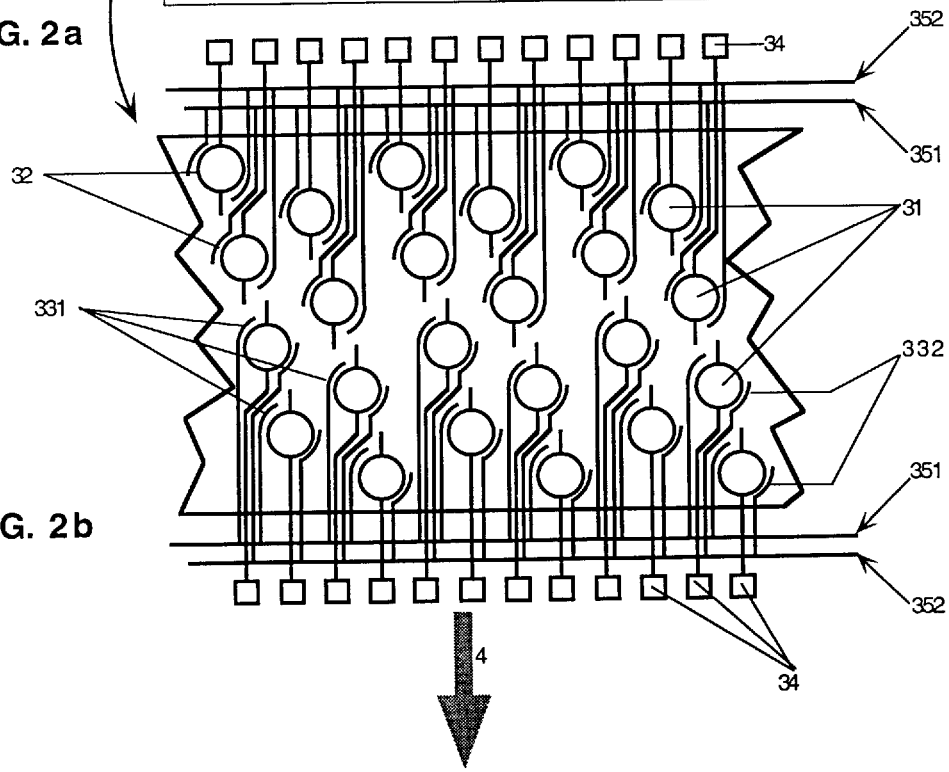
FIG. 2*b* is an enlargement of FIG. 2*a;*

FIG. 2*a* is a schematic plan view of a control unit 3 comprising a control array 30 provided with a plurality of print electrodes and deflection electrodes. FIG. 2*b* is an enlargement of FIG. 2*a*, showing a part of the control array 30.

The control array 30 is preferably formed of an electrically insulating substrate of flexible, non-rigid material, such as polyimide or the like, overlaid with an etched circuit. The substrate is provided with a plurality of apertures 31 preferably arranged in parallel rows and columns. Each aperture is surrounded by a print electrode 32 and bordered by a pair of deflection electrodes 331, 332. Each print electrode 32 is individually connected to a stream control source 34. All first deflection electrodes 331 are connected to a first deflection source 351 and all second deflection electrodes 332 are connected to a second deflection source 352.

The parallel rows of apertures 31 extend transversally across the width of the print zone 22 in a direction perpendicular to the motion of the information carrier (arrow 4). The columns are aligned at a slight angle to the motion of the information carrier 4 to ensure complete coverage of the information carrier 4 by providing an addressable area at every point across a line in a direction transverse to the movement of the information carrier (arrow 4).

Figure 3:
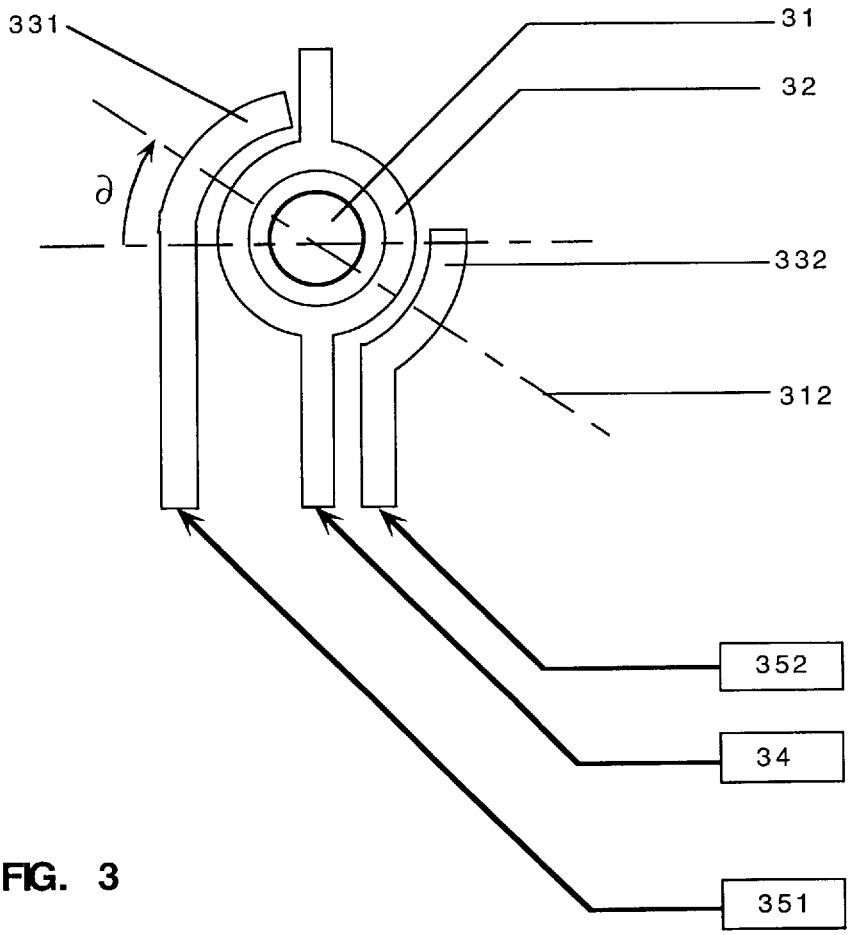
FIG. 3 is a schematic plan view of an aperture 31 arranged in a control array 30 in the apparatus according to the present invention.

FIG. 3 is an enlargement of the array 30 illustrating a single aperture 31 and its associated print electrode 32 and deflection electrodes 331, 332. Aperture 31 is a circular passage arranged through the substrate of the array 30 and surrounded by the ring-shaped print electrode 32 circumscribing the whole periphery of the aperture 31. A first deflection electrode 331 is spaced around a first segment of the circumference of the ring-shaped control electrode 32. As an electric potential is applied to the deflection electrode 331, a deflection force interacts with the electrostatic field generated by the print electrode 32, thereby altering the symmetry of that electrostatic field about the central axis of aperture 31 in the direction of said first segment, resulting in that charged particles transported through aperture 31 are slightly deflected from their initial trajectory and deposited on the information carrier at a position which is slightly displaced from the central axis of the aperture 31. A second deflection electrode 332 is spaced around a second segment of the circumference of the ring-shaped electrode 32, such that said first and second segments are symmetrically positioned about a central axis of the aperture 31. Both deflection electrodes 331, 332 are diametrically opposed with respect to a central axis of the aperture 31, along a deflection axis 312 extending through the aperture in a predetermined direction. As shown in FIG. 3, the deflection axis 312 is a line joining the centre of both deflection electrodes through the centre of the aperture 31 and intersecting a transverse axis of the aperture 31 at a deflection angle 6. The deflection axis 312 is offset with respect to the transverse axis of aperture 31 to compensate for the motion of information carrier 4, to thereby obtain transversal deflection on the information carrier 4 as the actual addressable area passes beneath the aperture.

In the embodiment shown, the print electrode 32 has a ring-shaped configuration and the deflection electrodes 331, 332 are arcuate segments extending around diametrically opposite portions of each print electrode 32. Accordingly, deflection electrodes 331, 332 apply additional forces which interact with the electrostatic field of the print electrode 32, influencing the resulting field symmetry about a central axis of aperture 31, causing a continuous distribution of toner particles through the aperture 31. The deflection electrodes 331, 332 are positioned to alter the field symmetry from an initial direction to the opposite direction.

The present invention, however, is not limited to round apertures nor to a particular shape of the control electrodes and deflection electrodes. It is contemplated that the apertures 31 and related print electrodes 32 may take any number of geometric forms, although shapes having symmetry about a central axis are advantageous to provide a uniform distribution of charged toner particles through the aperture 31. Likewise, there may be only one deflection electrode 33, or more than two, wholly depending on design criteria. For instance, the desired results may be achieved by utilizing only one deflection electrode supplied with an oscillating deflection signal to produce variable deflection forces in the vicinity of the aperture, said forces acting alternately attracting and repelling on the particle stream. FIGS. 2*a*, 2*b* and 3 show a preferred embodiment of a control unit in accordance to the present invention. However, those skilled in the art of etched circuit design will recognize that numerous design variations will accomplish the desired result.

Figure 9:
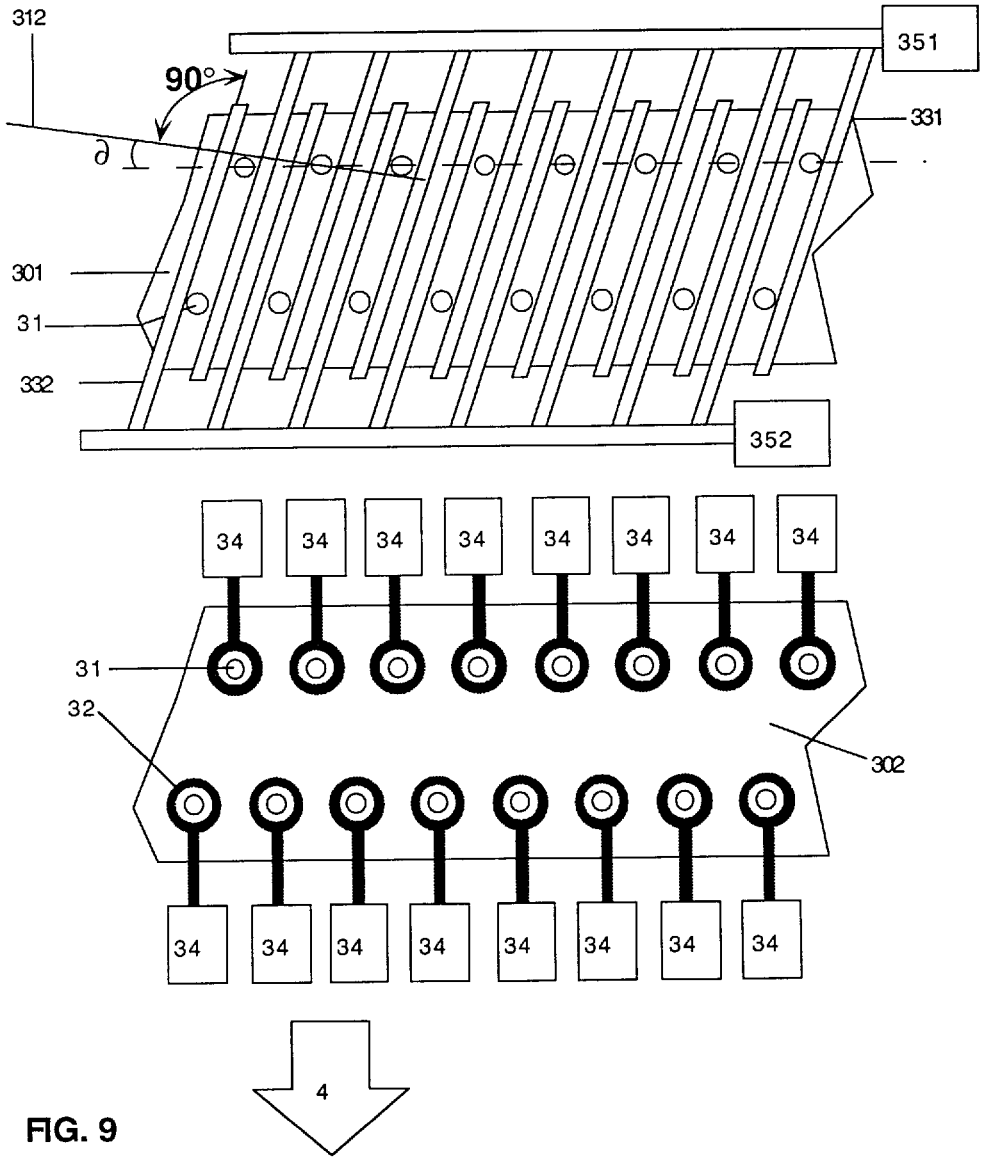
FIG. 9 shows an alternate embodiment of a control array in accordance with the present invention.

For instance, an alternate design of a control unit 3, shown in FIG. 9, illustrates a control array formed of two layers 301, 302. A first layer is overlaid with two sets of deflection electrodes 331, 332, extending parallel to each other and arranged at a deflection angle 6 with respect to the movement of the information carrier (arrow 4). A second layer 302 comprises the print electrodes 32.

Figure 4:
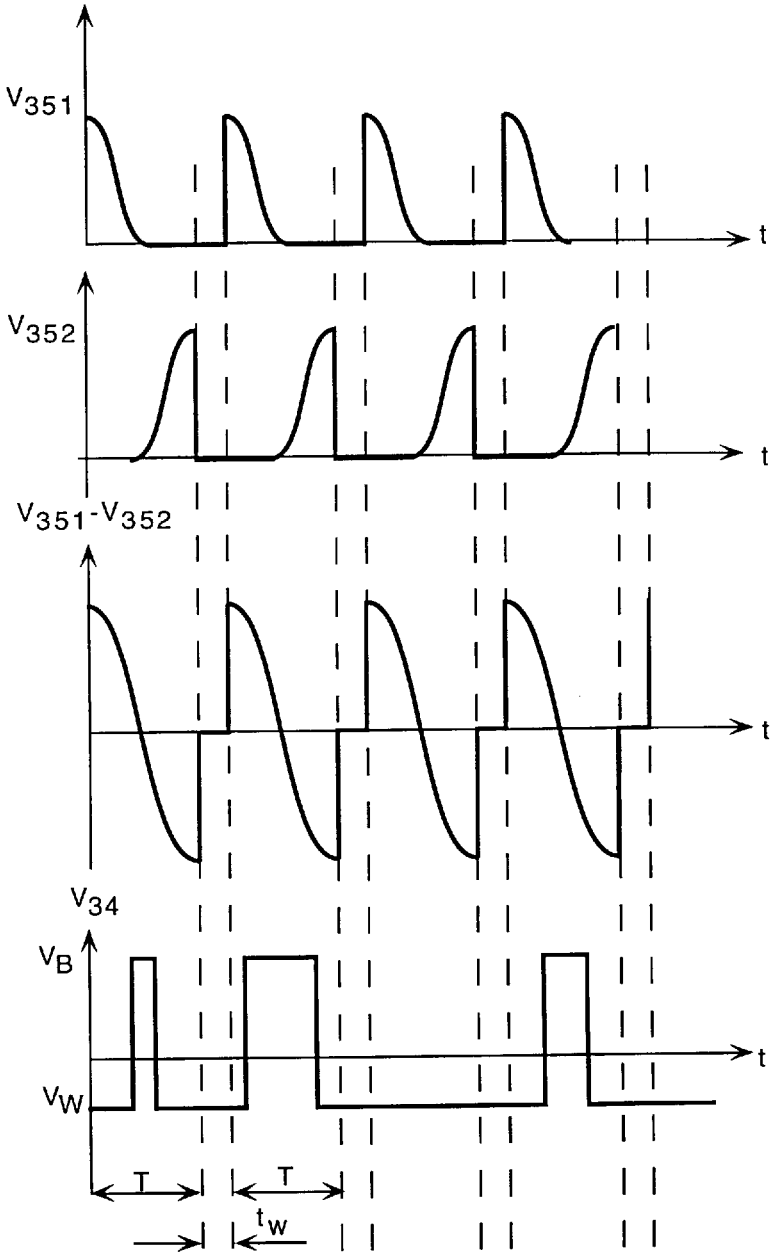
FIG. 4 illustrates the control of a particle stream through the aperture of FIG. 3.

FIG. 4 is an illustration of the control function of a direct printing method in accordance with the present invention.

FIG. 4 shows a first deflection potential $V_{351}$, a second deflection potential $V_{352}$, the difference there between ($V_{351}$-$V_{352}$), and a print potential $V_{34}$ as functions of time during four subsequent print sequences.

The image information through aperture 31 is supplied by the associated stream control source 34, connected to print electrode 32 to apply a print potential $V_{34}$. A periodic deflection potential $V_{351}$ decreases from a maximum level at t=0 to a minimum level at t=T/2, while a periodic deflection potential $V_{352}$ increases from a minimum level at t=T/2 to a maximum level at t=T. Accordingly, for each print sequence (0 to T) the potential difference ($V_{351}$-$V_{352}$) obtained between both deflection electrodes 331, 332 has a maximum level at t=0, corresponding to a maximum deflection from a central axis of aperture 31 toward the deflection electrode 331, and a minimum level at t=T, corresponding to maximum deflection in the opposite direction. As a result, the amount of particles transported during the actual print sequence is continuously distributed among variable trajectories toward the information carrier, resulting in variable addressed areas.

Both deflection signals are periodic pulses having a period corresponding to a print sequence (T). The stream control source 34 supplies the print electrode 32 with a pulse $V_{34}$ having variable amplitude and variable width. The pulse amplitude has any value between a black voltage $V_b$ and a white voltage $V_w$, chosen to be above and below a transport threshold value, respectively. The pulse width has any value between 0, in a non print condition, and a maximum value T, corresponding to complete coverage of the addressable area. Each print sequence T is followed by a white time $t_w$ during which new toner particles are conveyed to the print zone 22. The deflection sources 351, 352 supply deflection electrodes 331, 332 with periodic deflection pulses $V_{351}$, $V_{352}$, having a period T chosen to be equal to the print sequence time T, and a variable amplitude determining a deflection range.

Figure 5:
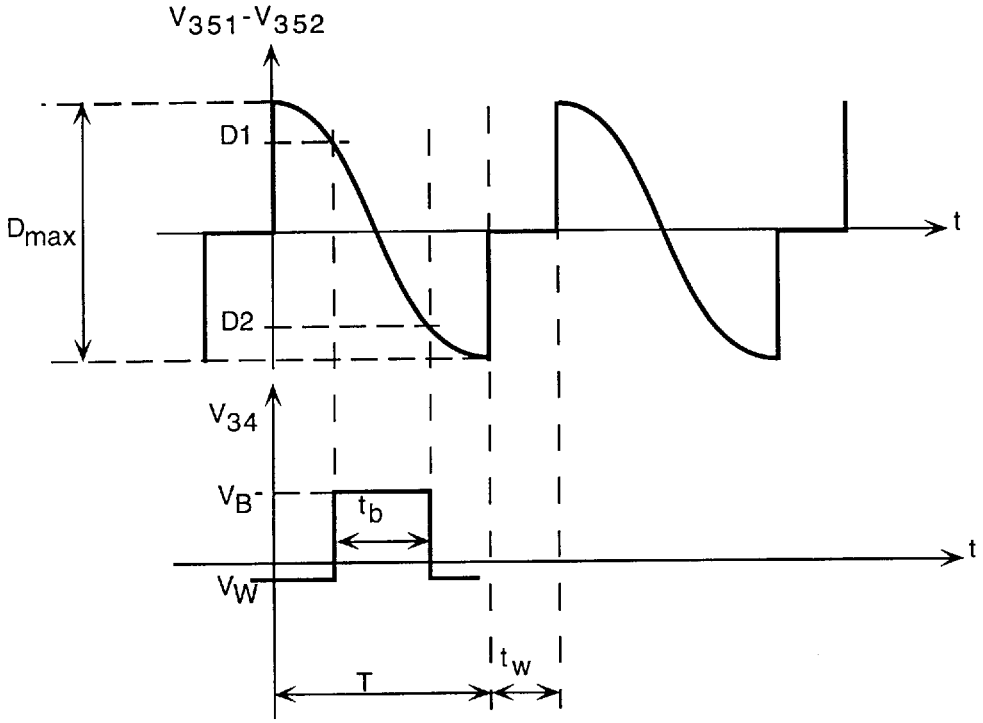
FIG. 5 is a more detailed illustration of the control function.
Figure 6:
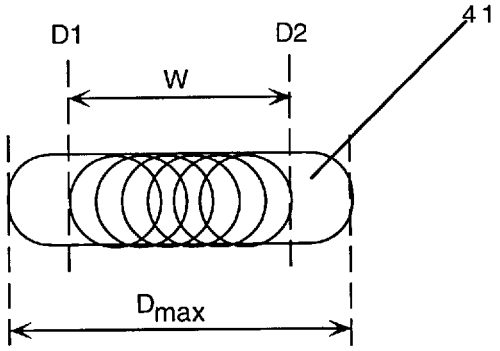
FIG. 6 illustrates a resulting printed area having addressed width W, obtained by applying the control function described in FIG. 5.

FIG. 5 illustrates the control function during a print sequence T. In the example shown, the pulse width of the print potential $V_{34}$ is chosen to extend between a first deflection level D1 and a second, opposite deflection level D2. The obtained deflection range D1–D2 is comprised within the entire deflection range $D_{max}$ and corresponds to an addressed area having a width W. The obtained printed area is illustrated in FIG. 6. The total addressable area 41 is partially darkened by charged particles scattered over a width W, corresponding to the actual deflection range D1–D2.

A method for controlling the particle transport, according to a preferred embodiment of the present invention, includes providing a first deflection electrode 331 in a first predetermined position with respect to each print electrode 32, and a second deflection electrode 332 in a second predetermined position with respect to each print electrode 32, said first and second deflection electrodes forming a pair of deflection electrodes such that each pair of deflection electrodes 331, 332 is positioned in a similar configuration about its associated print electrode 32; connecting all of the first deflection electrodes 331 to a first deflection source 351 generating a first deflection potential $V_{351}$ and connecting all of the second deflection electrodes 332 to a second deflection source 352, generating a second deflection potential $V_{352}$;

modulating both deflection potentials $V_{351}$,$V_{352}$ to produce a variable potential difference $V_{351}$-$V_{352}$ between each pair of deflection electrodes 331, 332;

supplying print potentials $V_{34}$ to the print electrodes 32 to produce electrostatic fields permitting or restricting the transport of charged particles from the particle source;

varying the deflection potential difference $V_{351}$-$V_{352}$ continuously during each print sequence (T), thereby applying a variable deflection force in the vicinity of each print electrode 32, said variable deflection force modifying the symmetry of each electrostatic field to continuously spread the transported particles, and modulating the pulse width of the print potential $V_{34}$ such that each electrostatic field is applied between two levels of the deflection potential difference $V_{351}$-$V_{352}$, corresponding to a specific deflection range.

According to that method, an aperture 31 corresponds to an addressable area 41. The pulse width of the applied print potential $V_{34}$ determines the portion of the addressable area 41 which is to be coated by toner particles. The complete coverage of an addressable area 41 is obtained by applying the control potential $V_{34}$ during the whole deflection range of the deflection potential difference $V_{351}$-$V_{352}$. The addressed area is made smaller by applying a control potential $V_{34}$ during only a part of a deflection period, causing particles to be deflected within a smaller deflection range.

Figure 7:
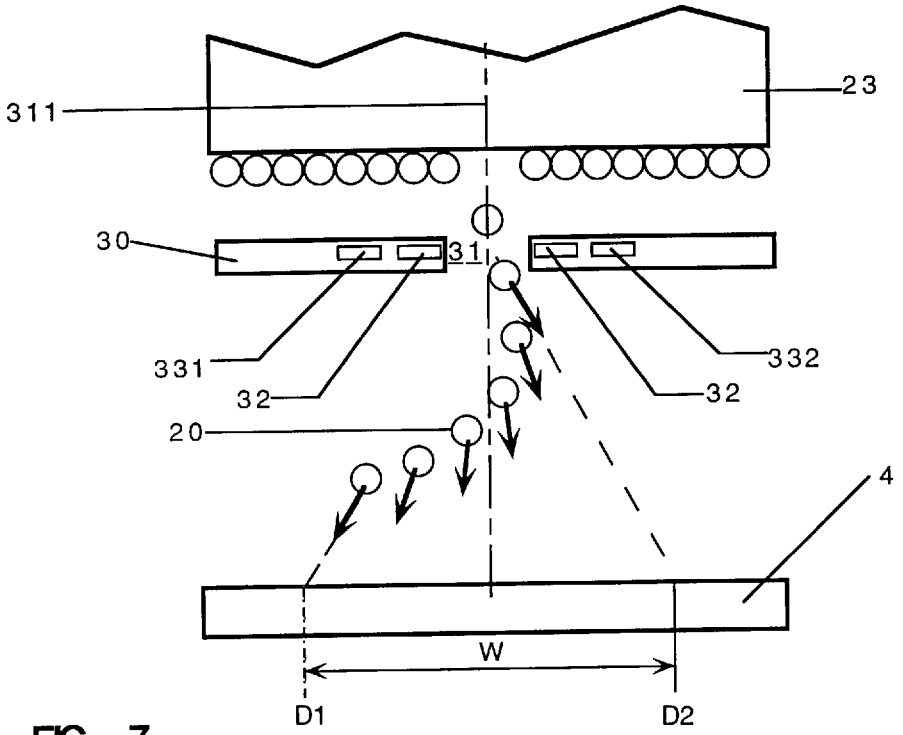
FIG. 7 is a simplified schematic sectional view of the print zone across the aperture of FIG. 3, as the control function of FIG. 5 is applied.

FIG. 7 is a sectional view of the print zone through an aperture 31, such as that shown in FIG. 3, while the control function of FIG. 5 is performed. FIG. 7 is greatly simplified to clearly illustrate the variable trajectories of transported particles 20. Particles 20 are initially transported along a straight path coinciding with the central axis 311 of the aperture 31. The first particles that pass through the aperture 31 are deflected from the central axis 311 due to the deflection force generated by the deflection electrode 331, acting on the particle stream in the beginning of the print sequence T. As the particles pass through aperture 31, the potential difference $V_{351}$-$V_{352}$ is sweeping along the deflection axis, continuously modifying the direction of deflection forces acting on the particles 20 from a first deflection level D1 to an opposite deflection level D2. The last particles that pass through apertures 31 are deflected from the central axis 311 by deflection forces generated by the deflection electrode 332 acting in a direction corresponding to deflection level D2. The obtained particle distribution extends across a width W, comprised within the boundaries of the addressable area 41.

Figure 8:
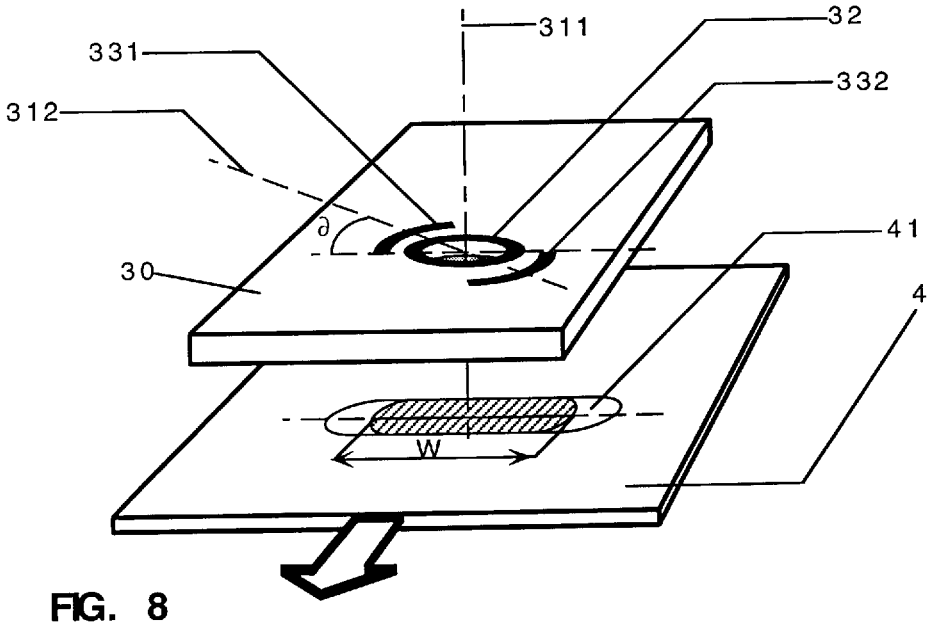
FIG. 8 is a schematic perspective view of the print zone in the vicinity of the aperture of FIG. 3, after the control function of FIG. 5 has been applied.

FIG. 8 is a schematic perspective view of the same procedure as that shown in FIG. 7. The deflection axis 312 intersects the transverse axis of the aperture 31 at a deflection angle δ such that the deflection electrode 331 and the deflection electrode 332 are located against and with the motion of the information carrier 4, respectively. The addressable area 41 related to aperture 31 is centered about the central axis 311. Particles are first deflected from central axis 311 toward deflection electrode 331, against the motion of the information carrier 4. As the deflection potential difference continuously decreases, the particle trajectory sweeps toward central axis 311, reaches a substantially straight path as the center of addressable area 41 arrives beneath aperture 31 and switches over to be deflected toward deflection electrode 332. The addressable area 41 is partially coated with particles, in accordance with the pulse width of control signal $V_{34}$.

Figure 10:
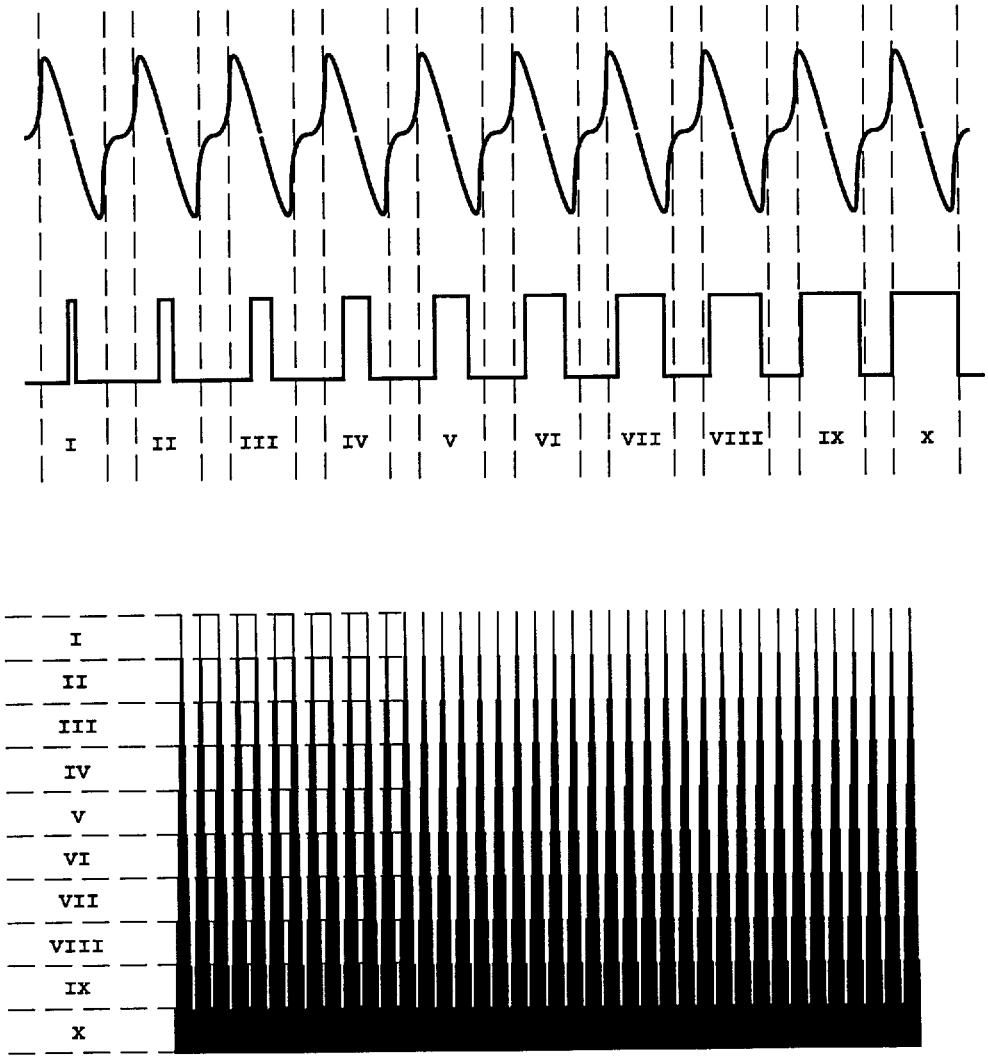
FIG. 10 is a schematic illustration of a method in accordance with the present invention, in which the control function is performed to enhance gray scale capability.

FIG. 10 illustrates the control function according to the present invention, as ten subsequent print sequences (I–X) are performed through a series of apertures. The pulse width of the print potential is modulated to create ten different gray shades (I–X), corresponding to ten different addressed widths.

What is claimed is:

1. A direct printing method in which an electrical potential pattern is produced by an electrode array disposed between a particle source and a back electrode, said electrode array comprising a plurality of print electrodes and a plurality of deflection electrodes, said method comprising the steps of:

positioning an image receiving information carrier between the electrode array and the back electrode;

producing an electrostatic potential difference between the particle source and the back electrode to apply an attractive field to charged particles;

modulating the transport of the charged particles from the particle source toward the back electrode by performing the steps of:

applying variable print potentials, defining the image information, to the print electrodes, said print potentials having sufficient magnitude to selectively permit or restrict the transport of charged particles from the particle source toward the information carrier, said variable print potentials applied to said print electrodes for respective selected time durations during each print period; and applying variable deflection potentials to the deflection electrodes during a deflection period said deflection potentials varying continuously during said deflection period to modify the trajectory of the particles transported toward the information carrier to define an addressable area to which said charged particles can be directed for each print electrode, said respective selected time duration for which said variable print potentials are applied to said each print electrode determining a portion of said addressable area to receive toner particles and a portion of said addressable area to not receive toner particles.

2. The method as claimed in claim 1, in which the electrode array comprises at least one set of deflection electrodes, each set of deflection electrodes being connected to a voltage source generating a variable deflection potential.

3. The method as claimed in claim 1, in which the print potentials have an amplitude between $V_w$ and $V_b$, where $V_w$ is below a transport threshold value, thereby preventing the transport of charged particles from the particle source toward the information carrier, and Vb is above said transport threshold value, thereby allowing the transport of charged particles from the particle source toward the information carrier.

4. The method as claimed in claim 1, in which the deflection potentials have a variable amplitude, said variable amplitude applying a variable deflection force to the charged particles during at least a part of each deflection period, thereby continuously modifying the trajectory of charged particles being transported toward the information carrier.

5. The method as claimed in claim 1, including:

providing at least two deflection electrodes in relation to each print electrode;

modulating the deflection potentials to produce a variable potential difference between said deflection electrodes, said potential difference having sufficient amplitude to apply deflection forces deflecting the trajectory of the particle stream during the transport of charged particles toward the information carrier, and varying said potential difference during at least a part of each deflection period from a first amplitude applying a deflection force in a first direction, to a second amplitude applying a deflection force in a direction opposed to said first direction.

6. The method as claimed in claim 5, in which each print potential is applied during at least a part of a deflection period, said part of the deflection period corresponding to a specific range of deflection forces.

7. The method as claimed in claim 5, in which the amplitude of the deflection potential difference varies continuously during each deflection period, thereby applying variable deflection forces which continuously modify the trajectory of transported particles during each deflection period.

8. The method as claimed in claim 5, in which a first deflection electrode is arranged in a first predetermined position with respect to each print electrode and a second deflection electrode is arranged in a second predetermined position with respect to each print electrode;

all of the first deflection electrodes are connected to a first voltage source generating a first deflection potential and all of the second deflection electrodes are connected to a second voltage source generating a second deflection potential.

9. A direct printing method in which an electrical potential pattern is produced by an electrode array disposed between a particle source and a back electrode, said electrode array comprising a plurality of print electrodes and a plurality of deflection electrodes, said method comprising the steps of:

positioning an image receiving information carrier between the electrode array and the back electrode;

producing an electrostatic potential difference between the particle source and the back electrode to apply an attractive field to charged particles;

modulating the transport of the charged particles from the particle source toward the back electrode by performing the steps of:

applying variable print potentials, defining the image information, to the print electrodes, said print potentials having sufficient magnitude to selectively permit or restrict the transport of charged particles from the particle source toward the information carrier, said print potentials having a pulse width between 0 and T, where T is the time of the deflection period; and applying variable deflection potentials to the deflection electrodes during a deflection period, said deflection potentials periodically varying during said deflection period to modify the trajectory of the particles transported toward the information carrier.

10. An image recording apparatus for depositing charged particles in an image configuration on an information carrier, comprising:

a back electrode;

a particle carrying unit positioned to convey charged particles to a particle source located adjacent to the back electrode;

an electrode array interposed between the particle source and the back electrode, said control array comprising a plurality of apertures, each aperture being controlled by at least one print electrode and at least one deflection electrode, wherein a particle receiving information carrier is positioned between the electrode array and the back electrode;

a back voltage source connected to the back electrode, to produce an electrostatic field between the back electrode and the particle source;

a plurality of variable voltage sources connected to apply print potentials to each print electrode during a print period, said control potentials having sufficient magnitude to selectively permit or restrict transport of the charged particles from the particle source to the information carrier, said print potentials applied to each print electrode for a respective selected time duration during each print period; and at least one deflection voltage source connected to apply continuously variable deflection potentials to said at least one deflection electrode, said deflection potentials having sufficient magnitude to modify the path trajectory of the charged particles transported toward the information carrier to define an addressable area to which said charged particles can be directed for each print electrode, said respective selected time duration for which said print potentials are applied to each print electrode determining a portion of said addressable area to receive toner particles and a portion of said addressable area to not receive toner particles.

11. The apparatus as defined in claim 10, in which said at least one print electrode comprises at least first and second electrodes positioned symmetrically about a central axis of an associated aperture.

12. The apparatus as claimed in claim 10, in which each aperture is surrounded by a print electrode, a first deflection electrode is spaced around a first segment of the circumference of each print electrode and a second deflection electrode is spaced around a second segment of the circumference of each print electrode, such that said first and second segment are symmetrically disposed about a central axis of the aperture.

* * * * *